US006154355A

United States Patent [19]

Altenburger et al.

[11] Patent Number: 6,154,355

[45] Date of Patent: Nov. 28, 2000

[54] APPARATUS AND METHOD FOR INDEPENDENTLY CONTROLLING MULTIPLE MATERIAL APPLICATORS

[75] Inventors: Gene P. Altenburger, Maumee; James P. Baltz, Waterville, both of Ohio

[73] Assignee: Illinois Tool Works Inc., Glenview, Ill.

[21] Appl. No.: 09/189,791

[22] Filed: Nov. 10, 1998

[51] Int. Cl.[7] ..... B05B 15/00

[52] U.S. Cl. ..... 361/191; 361/170; 239/76

[58] Field of Search ..... 361/170, 191, 361/227–228; 307/115, 118, 29, 38–39; 239/76, 75

[56] References Cited

U.S. PATENT DOCUMENTS

| | | | |
|---|---|---|---|
| 2,266,354 | 12/1941 | Christenson et al. . | |
| 2,748,036 | 5/1956 | Deitrickson . | |
| 3,831,845 | 8/1974 | Pacht . | |
| 3,893,006 | 7/1975 | Algeri et al. . | |
| 4,011,991 | 3/1977 | Masuda . | |
| 4,085,892 | 4/1978 | Dalton | 239/15 |
| 4,368,852 | 1/1983 | Sharp et al. . | |
| 4,530,463 | 7/1985 | Hiniker et al. . | |
| 4,607,987 | 8/1986 | Kice . | |
| 4,653,696 | 3/1987 | Rath, deceased et al. . | |
| 4,682,710 | 7/1987 | Turner, Jr. et al. . | |
| 4,706,885 | 11/1987 | Morin . | |
| 4,858,062 | 8/1989 | Hayakawa et al. . | |
| 4,858,828 | 8/1989 | Stachowiak . | |
| 4,959,137 | 9/1990 | Matsuoka et al. . | |
| 5,096,120 | 3/1992 | Luckarz . | |
| 5,271,569 | 12/1993 | Konieczynski et al. . | |
| 5,326,031 | 7/1994 | Konieczynski . | |

*Primary Examiner*—Michael J. Sherry

[57] ABSTRACT

An apparatus for independent voltage, air pressure, and/or fluid pressure control of multiple material or coating applicators, such as paint spray guns, includes a multiple gun control board that allows a single power supply to provide voltage to a plurality of paint guns and an independent gun control board that can output a different voltage signal for each gun to generate different gun operating voltages, different air pressures, and/or different fluid pressures. The independent gun control board includes a separate relay and potentiometer for each gun to be controlled. The potentiometer is adjustable so that the output voltage of the independent gun control board can be varied. The output voltage can be used to control the paint spray gun operating voltage and/or be sent to a pressure transducer to adjust the air and/or fluid pressure at which the triggered gun operates. The present invention therefore allows independent voltage and/or pressure control of each gun without requiring each gun to have its own separate power supply and pressure regulator, greatly reducing space and the number of components needed to operate multiple guns.

51 Claims, 7 Drawing Sheets

APPARATUS AND METHOD FOR INDEPENDENTLY CONTROLLING MULTIPLE MATERIAL APPLICATORS

TECHNICAL FIELD

The present invention relates to controllers for material applicators, such as spray paint guns and other paint applicators, and more particularly to controllers that independently control the air pressure, fluid pressure, and/or the operating voltage of paint applicators commonly used in industrial applications.

BACKGROUND ART

Electrostatic paint spray guns and other coating material applicators are commonly used in the automotive industry for coating automotive bodies and are also used in other industrial applications. Typically, in the past, the same spray gun was used to spray different paint colors. To change paint colors, a user would have to flush the gun with solvent thoroughly before loading the gun with the new paint color. In light of environmental concerns regarding emissions, however, many manufacturers have attempted to minimize or eliminate the flushing process by dedicating one gun to each paint color. Because different paint colors often have different properties, the operating voltage and air pressure for each gun must often be adjusted individually to optimize paint application for each color. One way to accomplish this individual gun control is by providing each gun with its own separate power supply and pressure regulator. Many manufacturers often use twenty or more spray guns, however, making it cumbersome to find space for all of the power supplies and pressure regulators controlling all of the guns.

It is therefore an object of the invention to control the operating characteristics of multiple spray paint guns independently without requiring each gun to have its own separate, individual power supply and pressure regulator.

SUMMARY OF THE INVENTION

Accordingly, the present invention is an apparatus for independently controlling the operating characteristics, such as the operating voltage, air pressure, and fluid pressure, of multiple spray guns. The present invention includes a multiple gun control board that allows a single power supply to control the operation of multiple spray paint guns. Because only one paint color, and therefore one gun, is operated at any given time, the multiple gun control board directs the output of a main supply board, which supplies a driving signal for the gun, to the activated gun and locks out all of the other guns from receiving the driving signal. As a result, if a second gun trigger is pulled while the first gun is activated, the driving signal is still routed to the first gun until its trigger is released.

The present invention also includes an independent gun control board that can output a different voltage signal for each gun to generate different gun operating voltages or different air/fluid pressures. The independent gun control board includes a separate relay and potentiometer for each gun to be controlled. The potentiometer is adjustable so that the driving signal of the independent gun control board can be varied to accommodate the particular paint characteristics being sprayed by each gun. The output voltage can be used to operate the gun and/or send it to an air/fluid pressure transducer to adjust the air and/or fluid pressure for an activated gun. The present invention therefore allows independent voltage and/or pressure control of each gun without requiring each gun to have its own separate power supply and pressure regulator, greatly reducing the space required in manufacturing facilities to accommodate the spray gun control hardware.

DETAILED DESCRIPTION OF THE PREFERRED EMBODIMENTS

Figure 1:
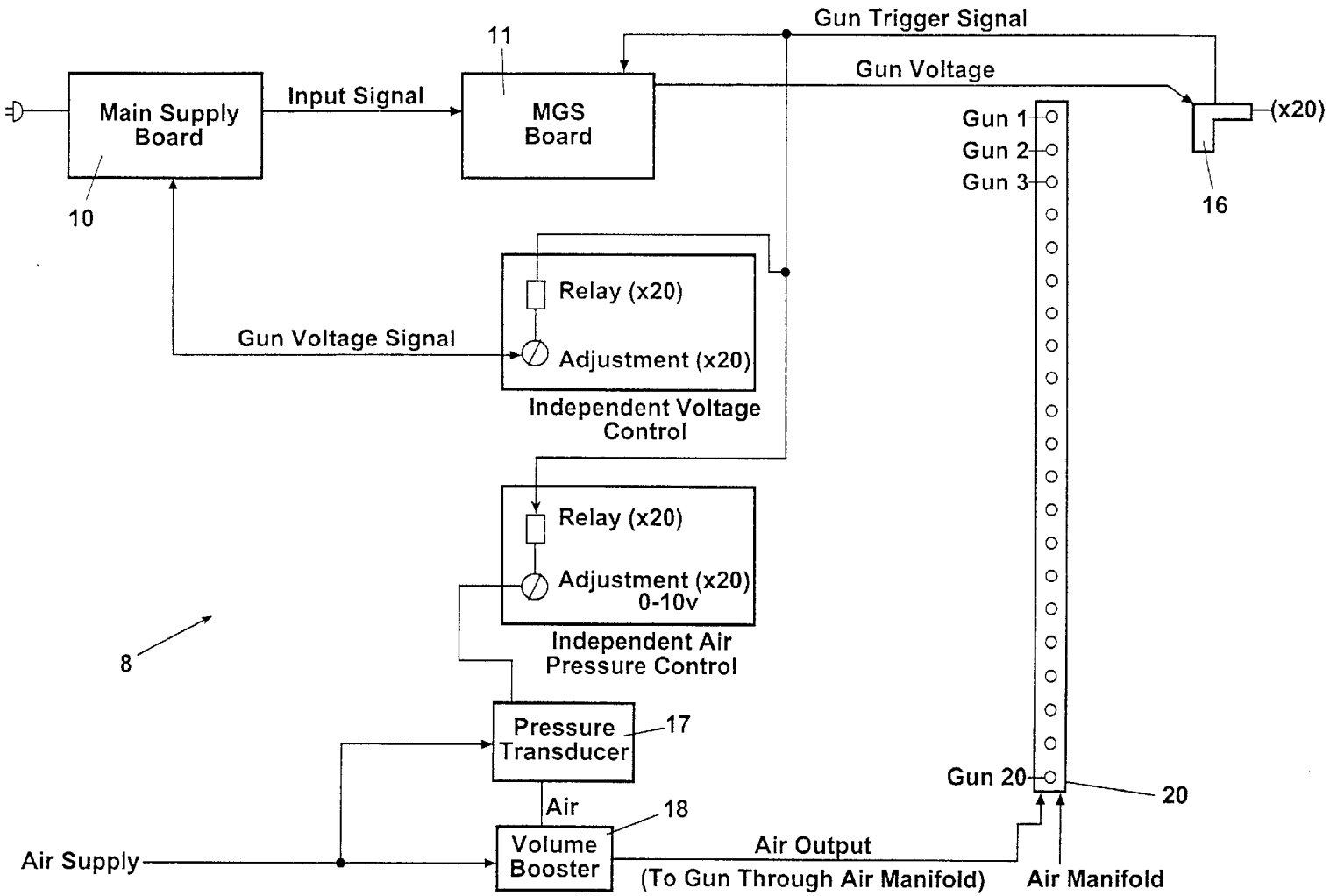
FIG. 1 is a representative block diagram showing a preferred spray gun system having independent gun controls according to one embodiment of the present invention.

FIG. 1 is a block diagram showing one possible embodiment of a spray gun system 8 having independent spray gun controls according to the present invention. The system includes a main supply board 10, a multiple gun system (MGS) microcontroller board 11, an independent gun control (IGC) voltage control board 12, an IGC air pressure control board 14, and a plurality of spray paint guns 16. Although FIG. 1 illustrates a 20-gun system, any number of guns can be controlled, from as few as two to as many as space will allow. The guns can also be placed in any configuration. Further, although the following description focuses on controlling a plurality of paint spray guns, the invention can control any material application device and is not limited to paint spray guns. The following description also specifies an IGC air pressure control board 14, but fluid pressure can be controlled as well, in a similar manner, without departing from the spirit of the invention.

FIG. 1 illustrates the connections for only Gun 1 for clarity. For air pressure control specifically, a pressure transducer 17, a volume booster 18 and an air manifold 20 may also be included. Regardless of the specific characteristic that a given IGC board 12, 14 controls (e.g., air pressure, fluid pressure, operating voltage), the operation of a preferred main supply board 10 is essentially the same for each IGC board 12, 14 and known to those of skill in the art, as will be understood from the description below.

Figure 2:
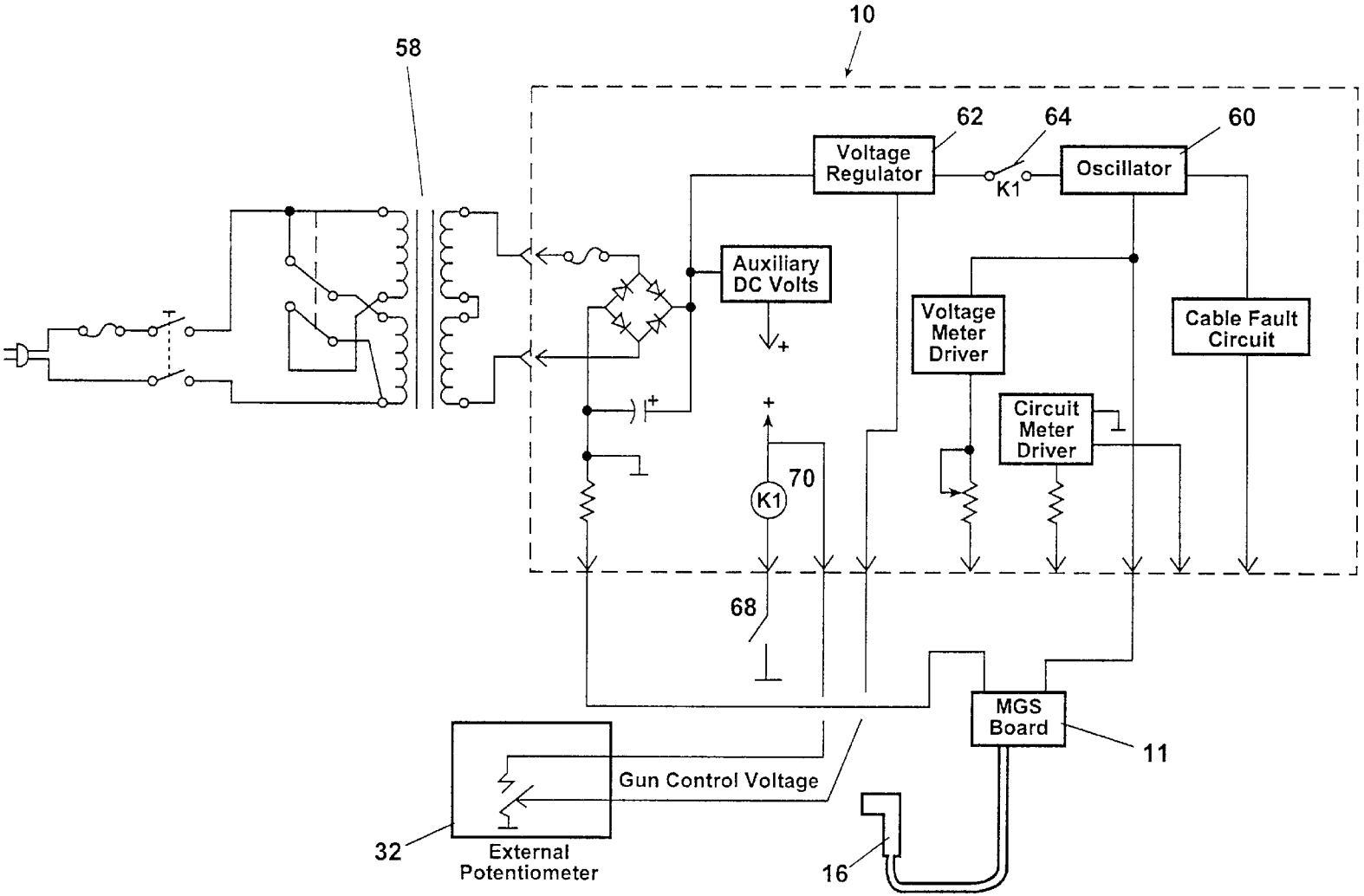
FIG. 2 is a schematic of a preferred main supply board in one embodiment of the present invention.
Figure 7:
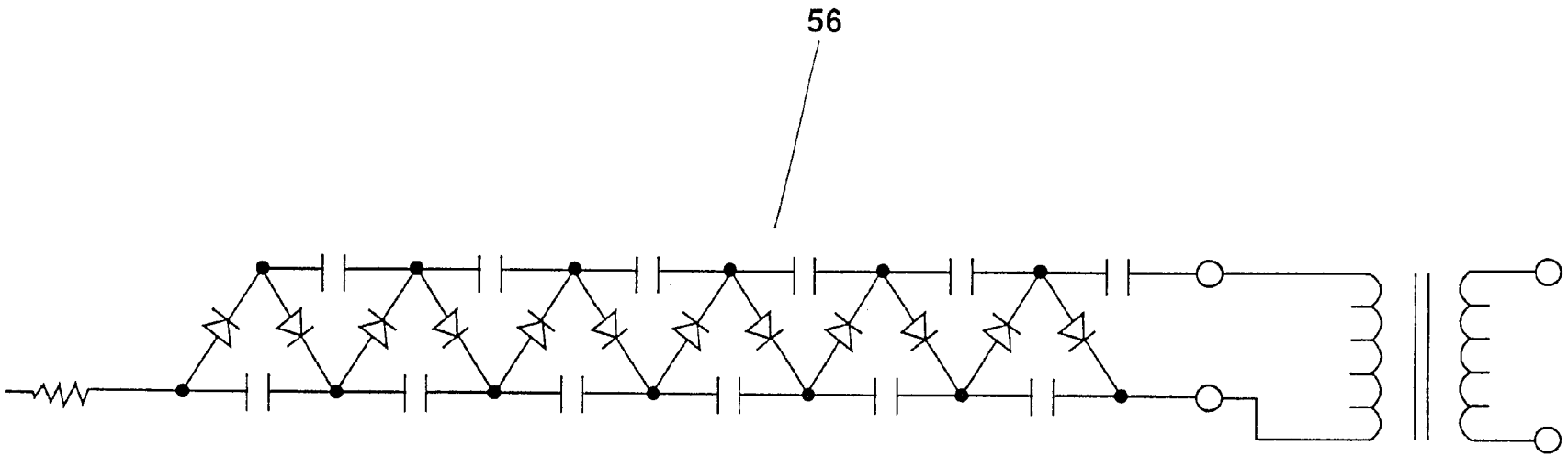
FIG. 7 illustrates an example of a cascade circuit that can be used in the independent spray gun controller of the present invention.

Referring to FIG. 2, the main supply board 10 generates the voltage signal that goes to an individual paint gun 16 when its trigger is pulled. The high voltage output of most electrostatic paint spray guns 16 is derived from an electronic circuit containing transformers, capacitors and diodes. This circuit is commonly called a cascade circuit because of the way in which the diodes and capacitors are cascaded together to generate the high voltage. A typical cascade circuit 56 is shown in FIG. 7 and is within the capabilities of those skilled in the art. In the present embodiment, the cascade circuit is located in the gun 16. Because of this, the input signal to the cascade circuit 56 should have a sufficiently high frequency so that the transformers and the capacitors of the cascade circuit are reasonably small in size.

In a preferred main supply board 10, as shown in FIG. 2, a conventional wall outlet plug connects a power source to the gun control system 8. In the preferred embodiment, the AC voltage from the power source is dropped down to 20 VAC via a step down transformer 58 before being supplied to the main supply board 10. On the main supply board, the 20 VAC is rectified to a DC voltage and fed to the input of an oscillator 60 through a voltage regulator circuit 62 and gun trigger relay contact K1 64. When a gun 16 is triggered, the air flow switch 68 energizes relay K1 70, closing relay contact K1 64 and supplying power to the oscillator. The output of the oscillator 60, in this embodiment, is about 10 V RMS at 15 Khz and is supplied to the MGS board 11, where the output is directed to the gun 16 whose trigger is pulled. An external potentiometer 32 connected to the voltage regulator circuit 62 allows infinite adjustment of the oscillator input voltage and thus its output to the gun 16. Using the potentiometer 32, the output of the gun can thus be adjusted between 0 and the maximum rated kV. In short, the main supply board 10 converts the 20 VAC, 50/60 kHz signal from the output of the step-down transformer 58 to a 10 VAC signal at a higher operating frequency (in this case, 15 kHz) that is compatible with the cascade circuit 56 being used.

Figure 3:
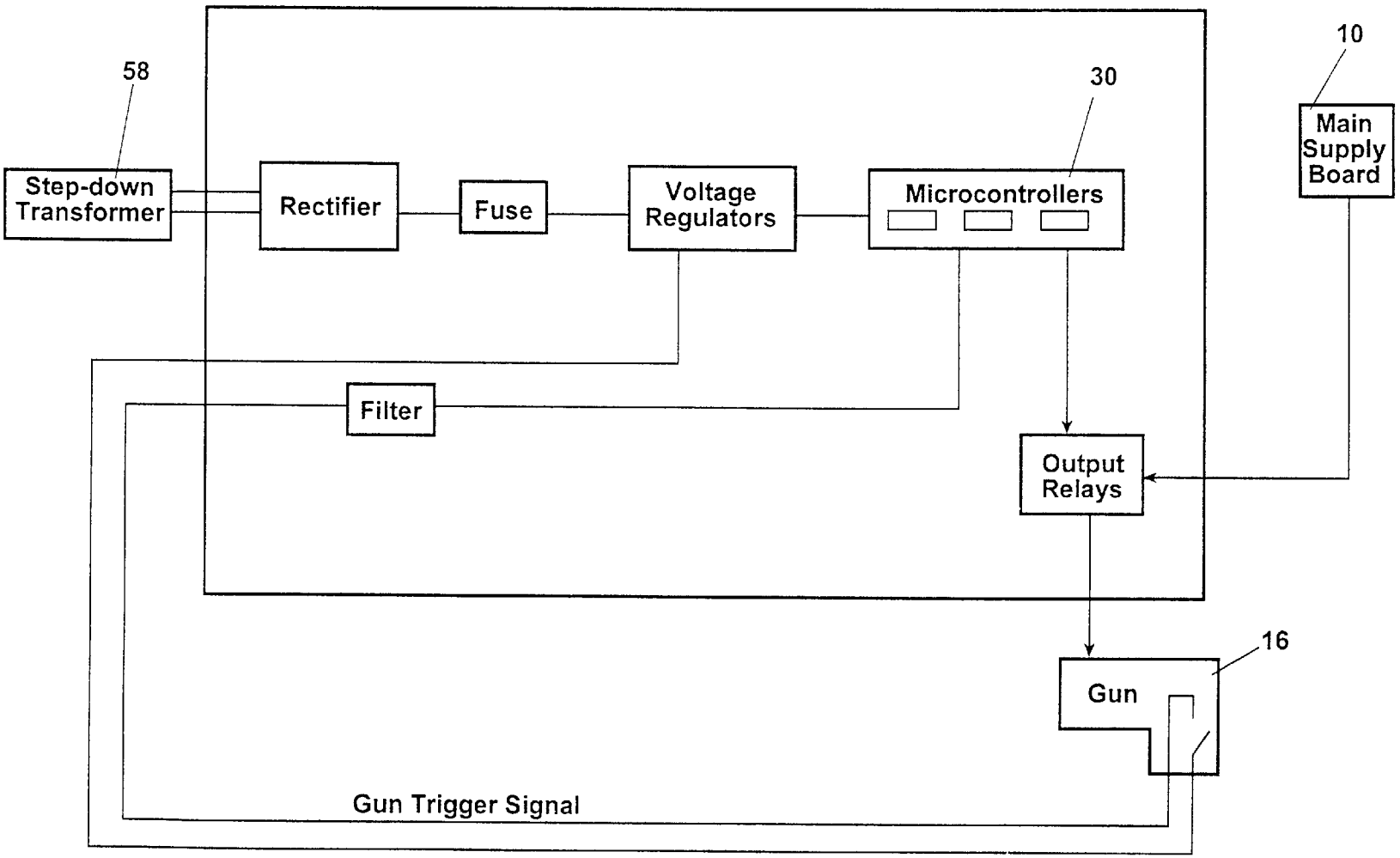
FIG. 3 is a schematic diagram of a multiple gun system board used in one embodiment of the invention.

A preferred MGS board 11, as shown in FIG. 3, includes a plurality of microcontrollers 30, each microcontroller 30 associated with a group of spray guns. Because only one paint color is sprayed at any given time, only one gun 16 will be operative at a time. The MGS board 11 enables multiple guns to be operated with only one power supply. When the user triggers a selected gun 16, the MGS board 11 directs the supply voltage from the main supply board 10 to the selected gun 16 and locks out the other guns from receiving the same supply voltage. If the trigger from a second gun is pulled while the first gun is operating, nothing will happen until the first gun's trigger is released.

Although the main supply board 10 and the MGS board 11 can be used together so that multiple guns 16 can be controlled using one supply voltage, there may be only one potentiometer 32 (referred to as the "external potentiometer") available for adjusting the voltage level controlling the activated gun. As a result of the single external potentiometer, all of the guns will be controlled by the same supply voltage. For operating voltage adjustments, for example, any signal from the main supply board 10 is routed through the same external potentiometer 32 before reaching a selected gun, making every gun receive the same operating voltage. As noted above, however, some users wish to operate each gun at a different voltage, particularly if each gun sprays a different paint color having different electrostatic properties. The user may wish to set one gun at 45 kV, the next at 60 kV, and the next at 50 kV, for example. On the other hand, a user still may wish to have the option of using the same voltage for all of the spray guns connected to the controller and not be bothered with individual voltage adjustments for each gun. The preferred embodiment of the present invention provides both options to the user, as will be detailed below.

Figure 4:
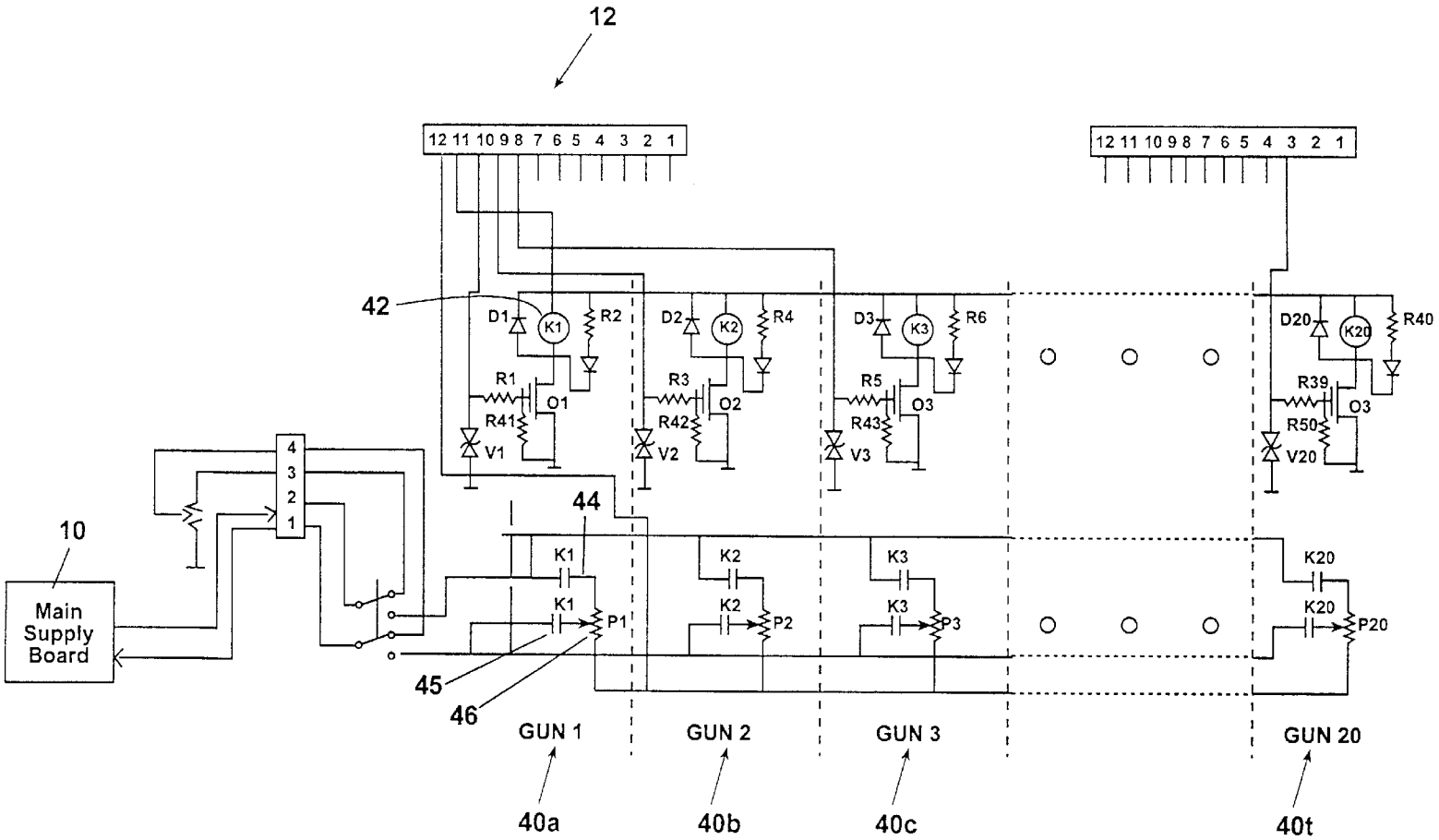
FIG. 4 is a schematic diagram of the independent spray gun controller with a voltage control output.

FIG. 4 illustrates one embodiment of the IGC voltage control board 12, which can provide independent voltage control adjustment for each gun 16. When the IGC voltage control board 12 is used in conjunction with the MGS board 11, the MGS board 11 directs the output of the main supply board 10 to one activated gun 16, and the IGC voltage board 12 is responsible for controlling "internal" potentiometers on the IGC voltage board 12 to vary the main supply board 10 signal such that each gun 16 can receive a different operating voltage, if desired. In this embodiment, the main supply board 10 is connected to the IGC voltage control board 12 through terminals 1 and 2 of bus J3 ("J3-1 and J3-2") to provide a supply signal to a selected gun 16. As can be seen in FIG. 4, each gun 16 has a control circuit 40*a* through 40*t* associated with it.

Switch 1SW in this embodiment is a double-throw switch to allow the user to select whether each gun voltage will be adjusted individually or whether the same operating voltage will be applied to all of the guns. As drawn, the switch 1SW connects the main supply board 10 to the external potentiometer 32 through the IGC voltage control board 12. In this switch 1SW position, the independent gun control feature of the IGC voltage control board 12 is essentially turned off. The wiper of the external potentiometer 32 is connected to J3-4 and the top of the external potentiometer, which receives the voltage from the main supply board 10, is connected to J3-3. As a result, the gun control voltage to and from the main supply board 10 is routed through the IGC control board 12 to the external potentiometer 32. Thus, when switch 1SW is in the position as drawn, the gun control voltage is routed to J3-2 of the IGC voltage control board 12, then through terminals 1 and 2 of switch 1SW, then through J3-3 of the IGC voltage control board 12 to the top of the external potentiometer 32. The voltage from the wiper of the external potentiometer 32 is then routed through J3-4 of the IGC voltage control board 12, then through terminals 4 and 5 of switch 1SW, then back out to the main supply board 10 via J3-1. Regardless of the specific gun 16 activated, the supply voltage will always be routed through the external potentiometer 32 when switch 1SW is in the illustrated position, and therefore the voltage signal sent to each gun 16, as it is activated, will be the same.

If the user wishes to adjust the operating voltage for each individual gun 16 independently, switch 1SW is switched down to disconnect the guns 16 from the external potentiometer 32 and allow the signal from the main supply board 10 to route through a selected internal potentiometer 46 in the voltage control IGC board 12 instead of through the external potentiometer 32. When switch 1SW is in this second position, the supply signal flows between terminals 2 and 3 and terminals 5 and 6 in 1SW. For simplicity, the IGC voltage control board 12 circuitry will be explained with respect to Gun 1, but the other guns 16 connected to the IGC voltage control board 12 are controlled in the same manner using the same circuitry as Gun 1.

The IGC voltage gun control board 12 shown in FIG. 4 will now be described in greater detail. As explained above, terminals 1 and 2 of bus J3 are connected to the main supply board 10, which generates the supply voltage. In this embodiment, pin 12 of bus J1 ("J1-12") is connected to ground, and J1-11 1 is connected to a 5V supply (not shown). Pin J1-10 is connected to, for example, a magnet operated reed switch located in the handle of Gun 1. Note that J1-10 can be connected to any type of switch (e.g. a pressure switch, an air flow switch, etc.) that operates the gun 16, and the switch does not necessarily have to be located in the gun 16. Further, Gun 1's reed switch is connected at the other end to the 5V supply. As a result, when the user pulls Gun 1's trigger and thereby closes its reed switch, pin J1-10 will be coupled to the 5V supply. The MGS board 11 is also coupled via Gun 1's reed switch to the 5V supply to direct the microcontroller 32 corresponding to Gun 1 to send the main supply board 10 output to Gun 1.

As will be described below, the magnetic reed switch of Gun 1 is coupled with relay K1 42 such that relay K1 42 energizes when Gun 1's magnetic reed switch closes. When Gun 1 is activated, current flows from pin J1-10 to the voltage divider formed by resistors R1 and R41 in the control circuit associated with Gun 1. Although the circuit 40*a* can operate satisfactorily using only gate resistor R1, incorporating a voltage divider drops the voltage level applied to the gate of MOSFET Q1 and prevents electrical noise from inadvertently triggering a gun whose trigger has not been pulled. A varistor V1 is also preferably connected to pin J1-10 to serve as a transient surge suppressor and eliminate any spikes that may travel down the line, preventing damage to components (MOSFET Q1 in particular) that are connected to the line. The varistor V1 grounds any voltage spikes that occur, as can be seen in FIG. 4.

MOSFET Q1 acts essentially as a switch that turns on when a voltage is applied to its gate. When Gun 1 is turned off (not triggered), MOSFET Q1 is switched off and is non-conductive; thus no current flows through relay K1 42 and MOSFET Q1 to ground. When a gate voltage reaches the MOSFET Q1 via the gate resistor R1, MOSFET Q1 turns on and becomes conductive. Because the top of relay K1 42 is connected to the 5V supply via pin J1-11, current flows down through relay K1 and MOSFET Q1; in short, relay K1 42 turns on when its associated MOSFET Q1 switch turns on.

In the preferred embodiment, a light emitting diode LED1 and a diode D1 are connected in parallel to the relay K1 42. When relay K1 42 is turned on, current also flows to LED1 so that it illuminates, providing visual confirmation to the user that the proper gun is operating. Diode D1 is a flyback diode to protect the relay K1 42 from voltage surges when MOSFET Q1 is turned off; because the relay K1 42 acts as an inductor, any sudden stoppage in the energy flow to the relay K1 42 may create a large spike as the relay K1 42 attempts to maintain its energy level. Diode D1 serves as an energy drain when MOSFET Q1 is turned off, providing an energy path for any spikes that may otherwise damage components in the IGC voltage control board 12.

When relay K1 is energized, its corresponding K1 contacts 44 and 45 close and thereby direct the supply signal to and from the main supply board 10 through the internal potentiometer P1 46 corresponding to Gun 1. The specific value of the internal potentiometer P1, which is set by the user, determines the specific voltage at which Gun 1 will be operated. In summary, by changing the position of switch 1SW downward, the user can redirect the supply voltage signal from the main supply board 10 away from the external potentiometer (not shown) and through any one of the individually adjustable internal potentiometers P1 through P20 such that each gun's operating voltage can be individually controlled by its corresponding potentiometer P1–P20. Adjusting each potentiometer can be accomplished by any known means, depending on the specific potentiometer model used. In a typical manufacturing environment, it is preferable to use potentiometers that have screwdriver-compatible controls and to place all of the potentiometer controls in a secured environment, such as a "lock-box", so that only authorized people can change the potentiometer settings.

Figure 5:
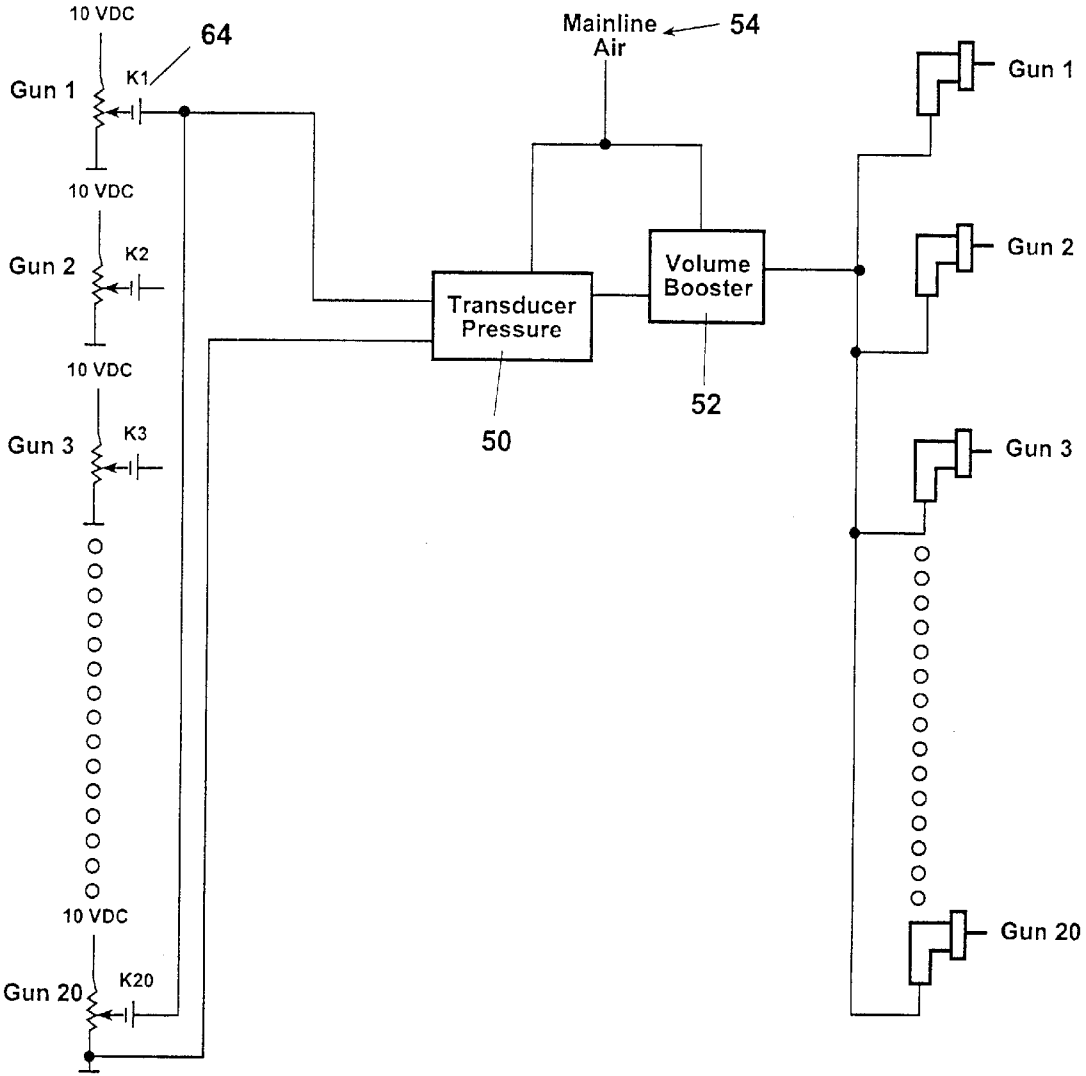
FIG. 5 is a simplified diagram showing the interconnection between the independent spray gun controller of FIG. 6 and an air supply.
Figure 6:
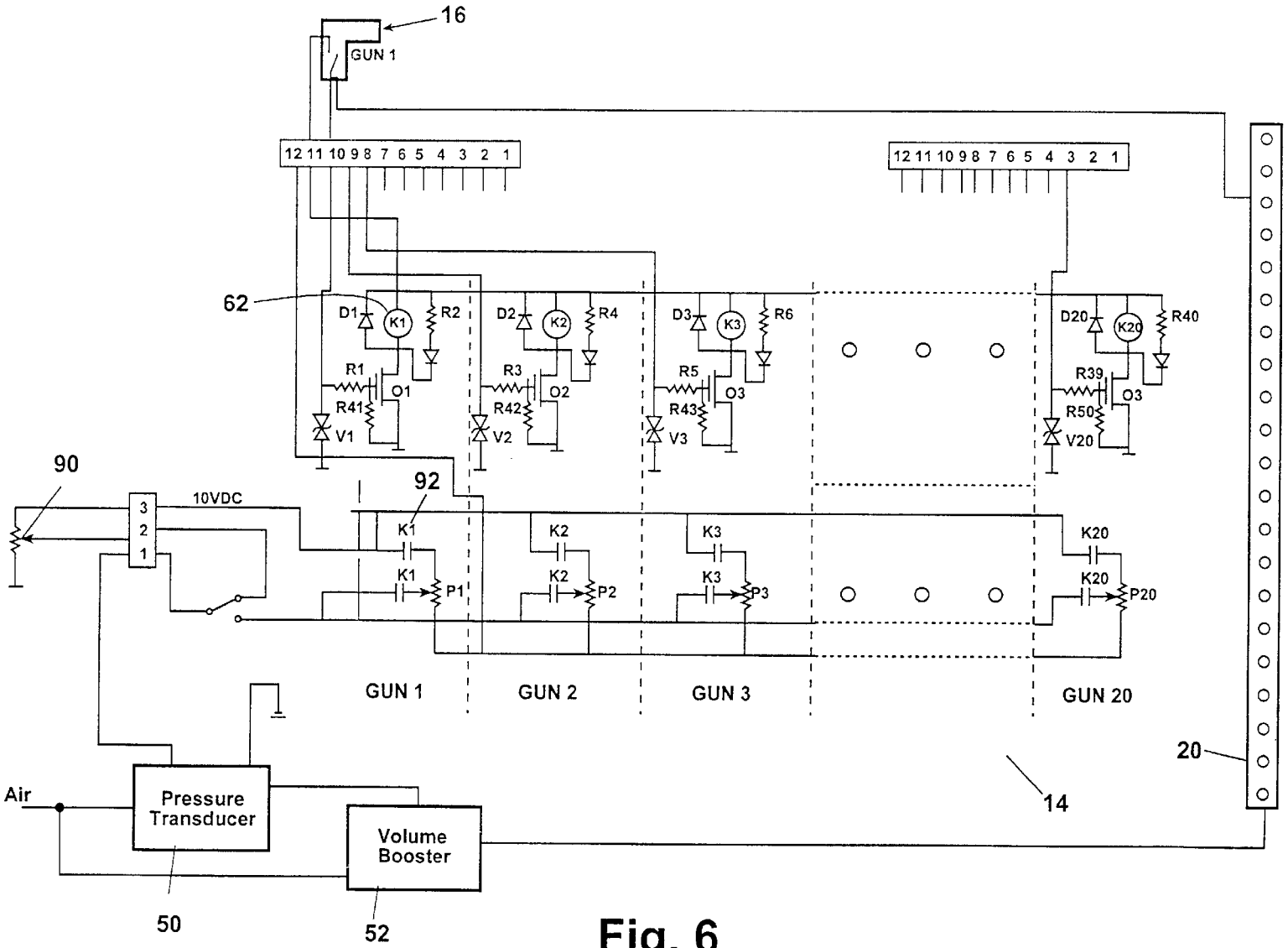
FIG. 6 is a schematic diagram of the independent spray gun controller with an air/fluid pressure control output.

FIGS. 5 and 6 illustrate the IGC air pressure control board 14, which controls each gun's air pressure rather than its operating voltage. FIG. 5 is a simplified diagram illustrating the interrelationship between the IGC air pressure control board 14 and other system components, and FIG. 6 is a more detailed schematic diagram of a preferred IGC air pressure board 14 embodiment. As can be seen in FIG. 6, the circuit structure and components of the IGC air pressure control board 14 in this embodiment are virtually identical to the IGC voltage control board 12 shown in FIG. 4. Both IGC boards 12 and 14 use internal potentiometers to vary the amount of voltage or air that is used to control each gun.

One main difference between the IGC voltage control board 12 and the IGC air pressure control board 14 is how the IGC potentiometer output is used. As illustrated in FIG. 6, the internal potentiometers P1 through P20 corresponding to the plurality of spray guns 16 are activated by relays 62 in the same manner as in the IGC voltage control board 12. For air regulation, however, the top of the potentiometer is preferably connected to a 10VDC power supply and the bottom connected to ground, as shown in FIG. 5 air pressure control board 14. Thus, the relay 62 can be a single pole relay, whereas a double pole relay 42 is needed for the IGC voltage control board 12. The IGC voltage output is coupled to a pressure transducer 50, as shown in FIG. 5. The pressure transducer 50 preferably has a 0 to 100 psi range and produces an air pressure output that is proportional to the voltage input of the pressure transducer 50. For example, if the internal potentiometer for a triggered gun is set such that 6V is sent to the pressure transducer 50, then the pressure transducer 50 will output 60 psi. Similarly, if the potentiometer is set so that only 2V reaches the pressure transducer 50, then the transducer 50 will output only 20 psi.

Although the pressure transducer 50 output has the desired air pressure as determined by the internal potentiometers P1–P20 in the IGC air pressure control board 14, it often does not have enough air flow to drive the paint guns 16. Thus, to increase the air flow, the output of the pressure transducer 50 is coupled with a volume booster 52. The volume booster 52 acts as a regulator that increases the amount of air going to the guns 16 without changing the air pressure. For example, if the pressure transducer 50 output is 50 psi, the output of the volume booster 52 will also be 50 psi, but the volume booster 52 output will have a greater flow volume than the pressure transducer 50 output. Both the pressure transducer 50 and the volume booster 52, as can be seen in FIG. 5, are connected to a main air line 54 that supplies the air for driving the paint guns 16.

Referring to FIG. 6, when the user pulls a gun trigger, signal flow between the external potentiometer 90, and the IGC air pressure control board 14 are the same as described above with respect to the IGC voltage control board 12. Further, the manner in which the components in the IGC air pressure control board 14 operate when a trigger is pulled is the same as in the IGC voltage control board 12 and will not be repeated in complete detail here. As in the previous embodiment, pulling the trigger of a selected gun 16 closes the reed switch in that gun 16, causing the gun's corresponding relay 62 on the IGC air pressure control board 14 to respond and connect the proper internal potentiometer P1–P20 in the IGC air pressure control board 14 to the pressure transducer 50. More particularly, assuming Gun 1's trigger is pulled, the relay K1 62 energizes, thereby closing the normally open contacts 92 and connecting the potentiometer P1 corresponding to Gun 1 16 to the pressure transducer 50, the output of which is then controlled by the potentiometer P1. As noted above, the potentiometer P1 setting dictates the voltage that is output from the IGC air pressure control board 14. Similar to the switch 1SW in the IGC voltage control board 12, a switch 2SW can be used in the IGC air pressure control board 14 to make all the air pressure settings the same without having to adjust all the potentiometers individually. A double throw switch is not necessary in the IGC air pressure control board 14 because the top of the potentiometers P1 through P20 are simply connected to the 10VDC supply via pin J3-3.

The IGC air pressure control board 14 allows individual control of the air pressure for each gun 16 without requiring a separate air regulator for each gun 16, resulting in significant space and cost savings. As in the IGC voltage control board 12, the potentiometer controls for the IGC air pressure control board 14 can be placed in a lock box to prevent unauthorized adjustment of the potentiometer settings.

As explained above, FIG. 1 illustrates a preferred embodiment where the gun control system 8 has both an IGC voltage control board 12 and an IGC pressure control board 14, but the IGC boards 12, 14 can be used individually as well if the user wishes to control independently either the operating voltage or the air pressure but not both. In the FIG. 1 arrangement, each individual gun will have two potentiometers associated with it, one in the IGC voltage control board 12 and one in the IGC air pressure control board 14, dedicated to its operation. The plurality of guns 16, as a whole, will preferably also have two corresponding external potentiometers, one potentiometer 32 for setting the operating voltage for all of the guns and one potentiometer 90 for setting the air pressure for all of the guns. Thus, a user has great flexibility in determining whether to adjust the voltage and/or air pressure of the paint guns individually or collectively, and whether one aspect should be adjusted collectively while the other is adjusted individually. The specific connections between the various boards and the guns are within the capabilities of those skilled in the art and will therefore not be explained here.

Variations of the structure shown in the figures and described above can be contemplated by those skilled in the art without departing from the scope of the invention. For example, as noted above, the invention is not limited to controlling paint spray guns, but can also control any number and any combination of other material applicators as well. The invention can be also used to adjust other paint gun operating characteristics, such as fluid pressure, by providing a fluid supply and using the adjusted voltage for varying the fluid pressure to the gun via a pressure transducer and fluid volume booster, similar to the air pressure control conducted by the IGC air pressure control board 14.

As another example, the main supply board 10, the MGS board 11, and the IGC boards 12, 14 can be combined onto a single electronic platform rather than divided into separate boards. In this example, the existing relays on the MGS board 11 can be expanded from double pole relays to multiple pole relays so that the voltage, air, or fluid potentiometers are selected by the multiple pole relays on the MGS board 11. Moving all the potentiometers to the MGS board 11 would eliminate the need for separate upper control circuitry, such as diodes, MOSFETS, and relays for the IGC air and voltage control boards. As a result, a microcontroller or combination of microcontrollers, together with a relay and potentiometers for each gun or other applicator, can be used to determine which gun has activated and send the desired voltage, air and/or fluid settings to that gun, locking out all other guns until the selected gun has been deactivated.

It should be understood that various alternatives to the embodiments of the invention described herein may be employed in practicing the invention. It is intended that the following claims define the scope of the invention and that the methods and apparatus within the scope of these claims and their equivalents be covered thereby.

What is claimed is:

1. An apparatus for controlling a plurality of material applicators, comprising:

a power supply for supplying an input signal to power an activated material applicator out of the plurality of material applicators;

a plurality of controllers that allow transmission of the input signal to the activated material applicator and prevent transmission of the input signal to non-activated material applicators;

a plurality of contacts corresponding to the plurality of material applicators;

a plurality of independently adjustable signal regulators, each adjustable signal regulator corresponding with one of the plurality of contacts and one of the plurality of material applicators, wherein the contact corresponding to the activated material applicator closes to allow the input signal from the power supply to be modified by the independently adjustable signal regulator corresponding to the activated material applicator to generate an adjusted signal that controls an operating characteristic of the activated material applicator.

2. The apparatus of claim 1, wherein the plurality of contacts corresponds to a plurality of relays, and wherein the relay corresponding to the activated material applicator energizes, thereby closing the contacts corresponding to the energized relay.

3. The apparatus of claim 1, wherein the input signal is an input voltage, and wherein the plurality of independently adjustable signal regulators is a plurality of potentiometers, each potentiometer capable of generating an adjusted voltage for controlling the operating characteristic of the activated material applicator.

4. The apparatus of claim 3, wherein the operating characteristic controlled by the adjusted voltage is an operating voltage for the activated material applicator, and wherein the operating voltage for the activated material applicator is proportional to the adjusted voltage.

5. The apparatus of claim 3, further comprising:

an air supply; and an air controller coupled with the air supply and the plurality of potentiometers, wherein the operating characteristic controlled by the adjusted voltage is an operating air pressure for the activated material applicator, and wherein the operating air pressure for the activated material applicator is proportional to the adjusted voltage.

6. The apparatus of claim 5, wherein the air controller comprises:

a pressure transducer that is controlled by the adjusted voltage and outputs air having the operating air pressure, which is proportional to the adjusted voltage; and a volume booster coupled to the pressure transducer and the plurality of material applicators for increasing the volume of the air output from the pressure transducer and sending the increased air output, at the operating pressure, to the activated material applicator.

7. The apparatus of claim 3, further comprising:

a fluid supply; and a fluid controller coupled with the fluid supply and the plurality of potentiometers, wherein the characteristic controlled by the adjusted voltage is an operating fluid pressure for the activated material applicator, and wherein the operating fluid pressure for the activated material applicator is proportional to the adjusted voltage.

8. The apparatus of claim 7, wherein the fluid controller comprises:

a pressure transducer that is controlled by the adjusted voltage and that outputs a air output setting the operating fluid pressure, which is proportional to the adjusted voltage; and a fluid regulator coupled to the pressure transducer and the plurality of material applicators for sending fluid to the activated material applicator, at the operating fluid pressure, in an amount proportional to the air output received from the pressure transducer.

9. The apparatus of claim 3, wherein the operating characteristic controlled by the adjusted voltage is at least one selected from the group consisting of an operating voltage, an operating air pressure, and an operating fluid pressure.

10. The apparatus of claim 3, wherein said plurality of potentiometers is divided into a first set of potentiometers and a second set of potentiometers for generating a first adjusted voltage and a second adjusted voltage, respectively, to control a first material applicator operating characteristic and a second material applicator operating characteristic, respectively, and wherein said apparatus further comprises:

a pressure controller coupled with said first set of potentiometers, wherein the first characteristic controlled by the first adjusted voltage is an operating pressure for the activated material, and wherein the operating pressure for the activated material applicator is proportional to the first adjusted voltage, and wherein the second operating characteristic controlled by the second adjusted voltage is an operating voltage for the activated material applicator, and wherein the operating voltage for the activated material applicator is proportional to the second adjusted voltage.

11. The apparatus of claim 10, wherein the operating pressure controlled by the pressure controller is an operating air pressure.

12. The apparatus of claim 10, wherein the operating pressure controlled by the pressure controller is an operating fluid pressure.

13. The apparatus of claim 10 wherein the plurality of contacts are divided into a first set of contacts and a second set of contacts corresponding to said first and second sets of potentiometers, respectively, and wherein said first set of contacts and first set of potentiometers are located on a first board and said second set of contacts and second set of potentiometers are located on a second board separate from the first board.

14. The apparatus of claim 13, wherein the plurality of contacts corresponds to a plurality of relays, and wherein the relay corresponding to the activated material applicator energizes, thereby closing the contacts corresponding to the energized relay.

15. The apparatus of claim 10 wherein the plurality of contacts are divided into a first set of contacts and a second set of contacts corresponding to said first and second sets of potentiometers, respectively, and wherein said first set of contacts, said first set of potentiometers, said second set of contacts, and said second set of potentiometers are located on a single board.

16. The apparatus of claim 15, wherein the plurality of contacts corresponds to a plurality of relays, and wherein the relay corresponding to the activated material applicator energizes, thereby closing the contacts corresponding to the energized relay.

17. The apparatus of claim 1, further comprising:

an external adjustable signal regulator separate from said plurality of independently adjustable signal regulators and coupled to said power supply; and a switch coupled to said external adjustable signal regulator and said plurality of independently adjustable signal regulators, the switch being movable between a first position where the external adjustable signal regulator is coupled to the plurality material applicators to generate the adjusted voltage for controlling the operating characteristic of the activated material applicator and a second position where one of said plurality of independently adjustable signal regulators generates the adjusted voltage for controlling the operating characteristic of the activated material applicator.

18. The apparatus of claim 3, further comprising:

an external potentiometer separate from said plurality of potentiometers and coupled to said power supply; and a switch coupled to said external potentiometer and said plurality of potentiometers, the switch being movable between a first position where the external potentiometer is coupled to the plurality of material applicators to generate the adjusted voltage for controlling the operating characteristic of the activated material applicator and a second position where one of said plurality of potentiometers generates the adjusted voltage for controlling the operating characteristic of the activated material applicator.

19. The apparatus of claim 1 wherein the material applicator is a paint spray gun.

20. An apparatus for depositing materials on an object, comprising:

a plurality of material applicators;

a power supply for supplying an input signal to power an activated material applicator out of said plurality of material applicators;

a plurality of controllers that allow transmission of the input signal to the activated material applicator and prevent transmission of the input signal to non-activated material applicators;

a plurality of contacts corresponding to the plurality of material applicators;

a plurality of relays corresponding to the plurality of contacts;

a plurality of independently adjustable signal regulators, each independently adjustable signal regulator corresponding with one of the plurality of contacts and one of the plurality of material applicators, wherein the relay corresponding to the activated material applicator energizes to close the contact corresponding to the activated material applicator and allows the input signal from the power supply to be modified by the independently adjustable signal regulator corresponding to the activated material applicator to generate an adjusted signal that controls an operating characteristic of the activated material applicator.

21. The apparatus of claim 20, wherein the input signal is an input voltage, and wherein the plurality of independently adjustable signal regulators is a plurality of potentiometers, each potentiometer capable of generating an adjusted voltage for controlling the operating characteristic of the activated material applicator.

22. The apparatus of claim 21, wherein the operating characteristic controlled by the adjusted voltage is an operating voltage for the activated material applicator, and wherein the operating voltage for the activated material applicator is proportional to the adjusted voltage.

23. The apparatus of claim 21, further comprising:

an air supply; and an air controller coupled with the air supply and the plurality of potentiometers, wherein the characteristic controlled by the adjusted voltage is an operating air pressure for the activated material applicator, and wherein the operating air pressure for the activated material applicator is proportional to the adjusted voltage.

24. The apparatus of claim 23, wherein the air controller comprises:

a pressure transducer that is controlled by the adjusted voltage and outputs air having the operating air pressure, which is proportional to the adjusted voltage; and a volume booster coupled to the pressure transducer and the plurality of material applicators for increasing the volume of the air output from the pressure transducer and sending the increased air output, at the operating air pressure, to the activated material applicator.

25. The apparatus of claim 21, further comprising:

a fluid supply; and a fluid regulator coupled with the fluid supply and the plurality of potentiometers, wherein the characteristic controlled by the adjusted voltage is an operating fluid pressure for the activated material applicator, and wherein the operating fluid pressure for the activated material applicator is proportional to the adjusted voltage.

26. The apparatus of claim 25, wherein the fluid controller comprises:

a pressure transducer that is controlled by the adjusted voltage and that outputs a air output having the operating fluid pressure, which is proportional to the adjusted voltage; and a fluid regulator coupled to the pressure transducer and the plurality of material applicators for sending fluid to the activated material applicator, at the operating fluid pressure and in an amount proportional to the air output received from the pressure transducer.

27. The apparatus of claim 21, wherein the operating characteristic controlled by the adjusted voltage is at least one selected from the group consisting of an operating voltage, an operating air pressure, and an operating fluid pressure.

28. The apparatus of claim 21, wherein said plurality of potentiometers is divided into a first set of potentiometers and a second set of potentiometers for generating a first adjusted voltage and a second adjusted voltage, respectively, to control a first material applicator operating characteristic and a second material applicator operating characteristic, respectively, and wherein said apparatus further comprises:

a pressure controller coupled with said first set of potentiometers, wherein the first characteristic controlled by the first adjusted voltage is an operating pressure for the activated material applicator, and wherein the operating pressure for the activated material applicator is proportional to the first adjusted voltage, and wherein the second operating characteristic controlled by the second adjusted voltage is an operating voltage for the activated material applicator, and wherein the operating voltage for the activated material applicator is proportional to the second adjusted voltage.

29. The apparatus of claim 28, wherein the operating pressure controlled by the pressure controller is an air pressure.

30. The apparatus of claim 28, wherein the operating pressure controlled by the pressure controller is a fluid pressure.

31. The apparatus of claim 28 wherein the plurality of contacts and relays are divided into a first set of contacts and relays and a second set of contacts and relays corresponding to said first and second sets of potentiometers, respectively, and wherein said first set of contacts and relays and first set of potentiometers are located on a first board and said second set of contacts and relays and second set of potentiometers are located on a second board separate from the first board.

32. The apparatus of claim 28 wherein the plurality of contacts are divided into a first set of contacts and relays and a second set of contacts and relays corresponding to said first and second sets of potentiometers, respectively, and wherein said first set of contacts and relays, said first set of potentiometers, said second set of contacts and relays, and said second set of potentiometers are located on a single board.

33. The apparatus of claim 20, further comprising:

an external adjustable signal regulator separate from said plurality of independently adjustable signal regulators and coupled to said power supply; and a switch coupled to said external adjustable signal regulator and said plurality of independently adjustable signal regulators, the switch being movable between a first position where the external adjustable signal regulator is coupled to the plurality of material applicators to generate the adjusted voltage for controlling the operating characteristic of the activated material applicator and a second position where one of said plurality of adjustable signal regulators generates the adjusted voltage for controlling the operating characteristic of the activated material applicator.

34. The apparatus of claim 21, further comprising:

an external potentiometer separate from said plurality of potentiometers and coupled to said power supply; and a switch coupled to said external potentiometer and said plurality of potentiometers, the switch being movable between a first position where the external potentiometer is coupled to the plurality of material applicators to generate the adjusted voltage for controlling the operating characteristic of the activated material applicator and a second position where one of said plurality of potentiometers generates the adjusted voltage for controlling the operating characteristic of the activated material applicator.

35. An apparatus for depositing materials on an object, comprising:

a plurality of material applicators;

a main supply board for supplying an input voltage to power an activated material applicator out of said plurality of material applicators;

a multiple material applicator system board including a plurality of microcontrollers, wherein when said multiple material applicator system board detects the activated material applicator, the microcontrollers allow transmission of the input signal to the activated material applicator and prevent transmission of the input signal to the non-activated material applicators;

an independent voltage control board including a first set of relays and a first set of contacts corresponding to the plurality of material applicators, and a first set of potentiometers, each potentiometer corresponding with one relay in the first set of relays and one of the plurality of material applicators, wherein the relay corresponding to the activated material applicator energizes and closes the contacts corresponding to the energized relay to allow the input voltage from the power supply to be regulated by the potentiometer in the first set of potentiometers corresponding to the activated material applicator to change an operating voltage of the material applicator;

an independent pressure control board including a second set of relays and a second set of contacts corresponding to the plurality of material applicators, and a second set of potentiometers, each potentiometer corresponding with one relay in the second set of relays and one of the plurality of material applicators, wherein the relay corresponding to the material applicator energizes and closes the contacts corresponding to the energized relay to allow the input voltage from the power supply to be regulated by the potentiometer in the second set of potentiometers corresponding to the activated material applicator to generate a pressure control voltage; and a pressure controller coupled with the second set of potentiometers, wherein a pressure output by the pressure controller is proportional to the pressure control voltage.

36. The apparatus of claim 35, wherein the pressure output controlled by the pressure controller is an air pressure.

37. The apparatus of claim 35, wherein the pressure output controlled by the pressure controller is a fluid pressure.

38. The apparatus of claim 35, further comprising an external potentiometer associated with said independent voltage control board, wherein said independent voltage control board further comprises a switch that is movable between a first position where the external potentiometer is coupled to the plurality of material applicators to control the operating voltage of the activated material applicator and a second position where one potentiometer in said first set of potentiometers controls the operating voltage of the activated material applicator.

39. The apparatus of claim 35, further comprising an external potentiometer associated with said independent pressure control board, wherein said independent pressure control board further comprises a switch that is movable between a first position where the external potentiometer is coupled to the plurality of material applicators to control the operating pressure of the activated material applicator and a second position where one potentiometer in said first set of potentiometers controls the operating pressure of the activated material applicator.

40. The apparatus of claim 39, wherein the multiple gun system control board further comprises a second external potentiometer associated with said independent voltage control board, wherein said independent voltage control board further comprises a switch that is movable between a first position where the second external potentiometer is coupled to the plurality of material applicators to control the operating voltage of the activated material applicator and a second position where one potentiometer in said first set of potentiometers controls the operating voltage of the activated material applicator.

41. A method for controlling a plurality of material applicators, comprising:

supplying an input signal to power an activated material applicator out of the plurality of material applicators;

allowing transmission of the input signal to the activated material applicator;

preventing transmission of the input signal to non-activated material applicators;

closing one of a plurality of contacts that corresponds to the activated material applicator to connect the activated material applicator with an independently adjustable signal regulator; and modifying the input signal using the independently adjustable signal regulator to generate an adjusted signal that controls an operating characteristic of the activated material applicator.

42. The method of claim 41, wherein the plurality of contacts corresponds to a plurality of relays, and wherein the method further comprises the step of energizing the relay corresponding to the activated material applicator, thereby closing the contacts corresponding to the energized relay.

43. The method of claim 41, wherein the input signal is an input voltage and the plurality of independently adjustable signal regulators is a plurality of potentiometers, and wherein the modifying step includes generating an adjusted voltage via the potentiometer corresponding to the activated material applicator for controlling the operating characteristic of the activated material applicator.

44. The method of claim 43, wherein the adjusted voltage generated in the modifying step controls an operating voltage for the activated material applicator such that the operating voltage for the activated material applicator is proportional to the adjusted voltage.

45. The method of claim 43, wherein the adjusted voltage generated in the modifying step controls an operating air pressure for the activated material applicator such that the operating air pressure for the activated material applicator is proportional to the adjusted voltage.

46. The method of claim 45, further comprising the steps of:

outputting air having the operating air pressure, which is proportional to the adjusted voltage, via a pressure transducer;

increasing the volume of the air output from the pressure transducer using a volume booster; and sending the increased air output to the activated material applicator.

47. The method of claim 43, wherein the adjusted voltage generated in the modifying step controls an operating fluid pressure for the activated material applicator such that the operating fluid pressure for the activated material applicator is proportional to the adjusted voltage.

48. The method of claim 47, further comprising the steps of:

outputting fluid having the operating fluid pressure, which is proportional to the adjusted voltage, via a pressure transducer;

increasing the volume of the fluid output from the pressure transducer using a fluid volume booster; and sending the increased fluid output at the operating fluid pressure to the activated material applicator.

49. The method of claim 43, wherein the operating characteristic controlled by the modifying step is at least one selected from the group consisting of an operating voltage, an operating air pressure, and an operating fluid pressure.

50. The method of claim 41, further comprising:

generating a first adjusted voltage and a second adjusted voltage, respectively, to control a first material applicator operating characteristic and a second material applicator operating characteristic, respectively;

controlling an operating pressure for the activated material applicator, wherein the operating pressure for the activated spray gun is proportional to the first adjusted voltage, and controlling an operating voltage for the activated material applicator, and wherein the operating voltage for the activated material applicator is proportional to the second adjusted voltage.

51. The method of claim 41, further comprising the step of:

selecting between a first connection where an external adjustable signal regulator is coupled to the plurality of spray material applicators to generate the adjusted voltage for controlling the operating characteristic of the activated material applicator and a second position where one of said plurality of independently adjustable signal regulators generates the adjusted voltage for controlling the operating characteristic of the activated material applicator.

* * * * *